United States Patent [19]

Breeden

[11] Patent Number: 4,493,437

[45] Date of Patent: Jan. 15, 1985

[54] CAULKING GUN WITH CUTTER AND PIERCER

[75] Inventor: Kenneth S. Breeden, Louisville, Ky.

[73] Assignee: Richard L. Caslin, Louisville, Ky.

[21] Appl. No.: 429,950

[22] Filed: Sep. 30, 1982

[51] Int. Cl.[3] ..... B67B 7/24

[52] U.S. Cl. ..... 222/82; 30/289

[58] Field of Search ..... 222/81-83, 222/80, 83.5, 325, 326, 391, 86, 88; 83/580; 30/92, 93, 95, 289, 295; 7/129, 132

[56] References Cited

U.S. PATENT DOCUMENTS

| | | | |
|---|---|---|---|
| 2,659,517 | 11/1953 | Reinhardt, Jr. | 222/82 |
| 3,189,226 | 6/1965 | Sherbondy | 222/82 |
| 4,135,644 | 1/1979 | Pacetti | 222/81 |

*Primary Examiner*—H. Grant Skaggs
*Assistant Examiner*—Kenneth Noland
*Attorney, Agent, or Firm*—Richard L. Caslin

[57] ABSTRACT

A standard caulking gun is shown having two new features added thereto. The first feature is a replaceable razor blade that is clamped in a notched edge of one wall of the hollow trigger. In combination with the razor blade is a hole in an adjacent wall of the hollow handle. Over the hole is placed an adjustable adapter having various size angular openings for cutting the tip off of the nozzle of a caulking tube at a 45° angle. The second new feature is an elongated pick built into the hollow handle to be retracted when not in use, and to be extendible for receiving the open nozzle thereover so as to pierce the seal of the tube.

17 Claims, 10 Drawing Figures

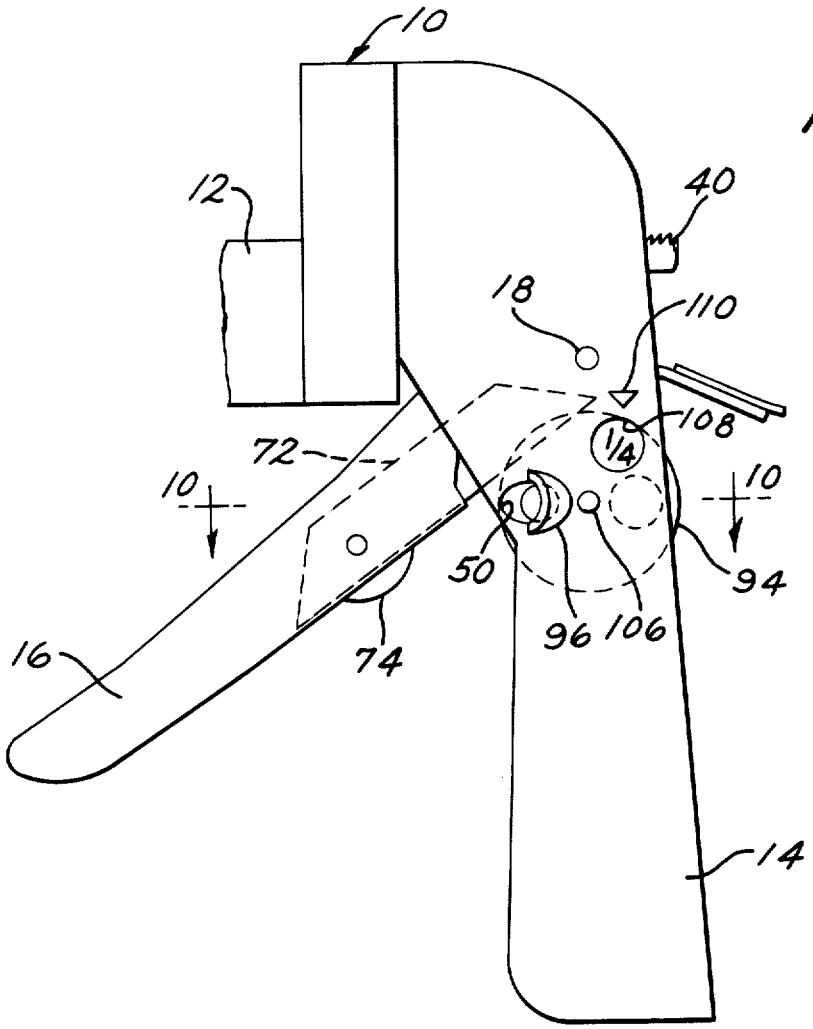
FIG. 8
FIG. 9
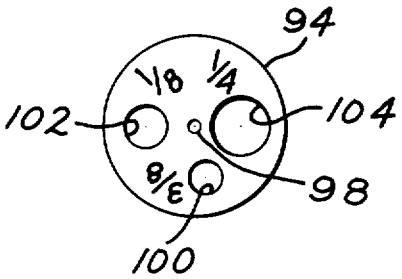
FIG. 10
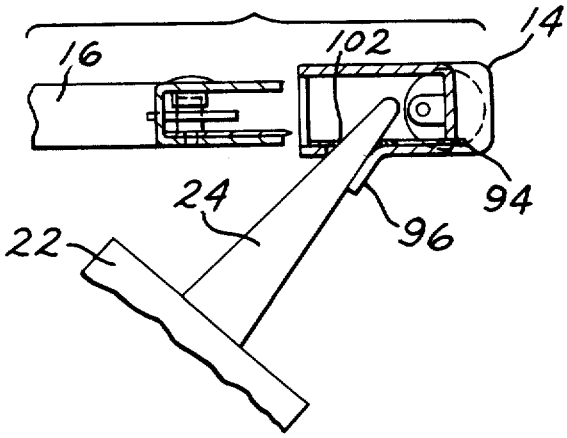

CAULKING GUN WITH CUTTER AND PIERCER

BACKGROUND OF THE INVENTION

1. Field of the Invention

This invention relates to caulking guns which are manually-actuated guns that are used to dispense caulking material from disposable tubes or cartridges. Such disposable caulking tubes or cartridges are provided with a paper tube for holding the caulking material. One end of the tube is sealed, and the other end is provided with a funnel-like plastic nozzle. These nozzles are molded with closed tips in order to provide an air seal in order to prolong the shelf life of the tube. Also, the inlet end of the nozzle is sealed by a thin diaphragm formed of metal foil or the like. The present invention relates to a caulking gun having a built-in cutter for removing the tip of the funnel-like nozzle of the caulking tube. Moreover, this invention provides an extendible pick built into the handle of the gun for piercing the seal at the inlet end of the nozzle.

2. Description of the Prior Art

For many years, painters and carpenters have opened these caulking tubes or cartridges by carrying a penknife plus a long nail or ice pick. Frequently, the painter is up on a ladder when he is using the caulking gun, and the tube or cartridge is exhausted within a short time, so that the disposable tube needs to be discarded and a new tube loaded into the gun. But the new tube cannot be used until the tip of the nozzle is removed and the seal of the tube is pierced.

The Sherbondy U.S. Pat. No. 3,105,614 shows a standard caulking gun having built into the pistol grip-type handle a shear blade that is mounted on the same pivot as the hollow trigger. This pivoted shear blade cooperates with a plurality of holes formed in an adjacent wall of the hollow handle so as to be able to slice off the tip of the funnel-like plastic nozzle of the caulking tube. One disadvantage of this pivoted shear blade design is that when it wears out, it cannot be replaced easily. Therefore, it becomes inoperative after a certain length of time.

A second patent to Sherbondy is U.S. Pat. No. 3,189,226 which shows a torsion spring fitted between the piston grip-type handle and the pivoted trigger of a standard caulking gun, where one leg of the torsion spring that is in the trigger is elongated to serve as a pick for insertion into the open end of the funnel-like nozzle of the caulking tube. The purpose of this pick is to pierce the seal of the tube adjacent the inlet end of the nozzle. This can only be done by pivoting the elongated leg of the torsion spring out from within the hollow trigger so that the tube may slip between the trigger and the handle, and move towards the pivot of the trigger until the seal of the tube is pierced. Otherwise, the free end of the pick would not be able to reach the seal in the tube because the presence of the trigger would prevent the tube from moving close enough to the pick.

The Reinhardt U.S. Pat. No. 2,659,517 describes a dispenser for coaction with a special container or cartridge for soaps, lotions or toothpaste. The dispenser is preferably designed to be wall-mounted. A cutter-valve member is built into the dispenser to trim off the closed tip of the nozzle of the cartridge, as well as to serve as a control of the flow from the cartridge.

OBJECTS OF THE PRESENT INVENTION

The principal object of the present invention is to provide a caulking gun with a built-in means for cutting off the tip of the funnel-like nozzle of a caulking tube or cartridge, where this cutting means has an easily replaceable keen-edged blade, such as a commonly available razor blade.

A further object of the present invention is to provide a caulking gun of the class described with cutting means that is safe for use without endangering the user.

A further object of the present invention is to provide a caulking gun with cutting means for removing the closed tip of a funnel-like nozzle that is provided on one end of the caulking tube or cartridge, where the cutting means makes it possible to trim the tip of the nozzle at an angle; for example, a 45° angle.

A still further object of the present invention is to provide a caulking gun with cutting means of the class described where the handle of the gun is fitted with an adjustable adapter having angular openings of different sizes so that the tip of the nozzle may be sliced along different lines on the nozzle so as to be able to create different size openings in the nozzle, depending upon the type of caulking, whether it is rubber, latex, silicone, or the like.

A further object of the present invention is to provide a caulking gun of the class described with a handle having a hidden pick that is extendible so as to be able to pierce the seal in the caulking tube or cartridge.

A further object of the present invention is to provide a caulking gun of the class described with a spring-biased, recessed pick in the handle which is operated by a thumb operator to be extendible out the bottom of the handle of the gun when the seal in the caulking tube is to be pierced.

SUMMARY OF THE INVENTION

The present invention provides a caulking gun of the standard type having a caulking tube-receiving barrel and a reciprocating plunger. Also, the gun has at one end of the barrel a pistol grip-type handle which has a pivot means carried near the top portion of the handle for receiving a trigger that is mounted on the pivot and adapted for operating the plunger that serves to discharge the contents of the caulking tube. Both the handle and the trigger are of hollow construction, and the trigger tends to telescope into the hollow handle when the trigger is squeezed. A hole is formed in one side wall of the handle, and one side wall of the trigger is provided with a notched edge that is adjacent the said hole. A keen-edged blade, such as a razor blade, is positioned within the trigger, near the notched edge, and an adjustable fastening means serves to hold the blade in place. The cooperation of the hole in the handle and the razor blade in the trigger serves as a cutting means for the tip of the nozzle of a caulking tube when the trigger is squeezed. An added feature is that the hollow handle of the gun is provided with an extendible pick which is normally recessed within the handle when not in use and which may be manually operated so that when it is fitted into the open end of the nozzle, it may reach and pierce the seal of the caulking tube.

BRIEF DESCRIPTION OF THE DRAWINGS

This invention will be better understood from the following description taken in conjunction with the accompanying drawings, and its scope will be pointed out in the appended claims.

FIG. 8 is a fragmentary side elevational view of the handle end of the caulking gun of a second modification of the present invention using a rotary adapter built into the hollow handle, where this adapter has a plurality of different size holes for accommodating the nozzle of the caulking tube at different positions along the length of the nozzle so as to be able to obtain a plurality of different size openings in the end of the nozzle, depending upon where the tip of the nozzle is cut along the length thereof.

FIG. 9 is a front elevational view of the rotary adapter or wheel that is shown mounted within the handle of FIG. 8.

FIG. 10 is a cross-sectional plan view, similar to that of FIG. 4, but taken through the trigger and handle of the second modification of FIG. 8 taken on the line 10—10.

DESCRIPTION OF THE PREFERRED EMBODIMENTS

Figure 1:
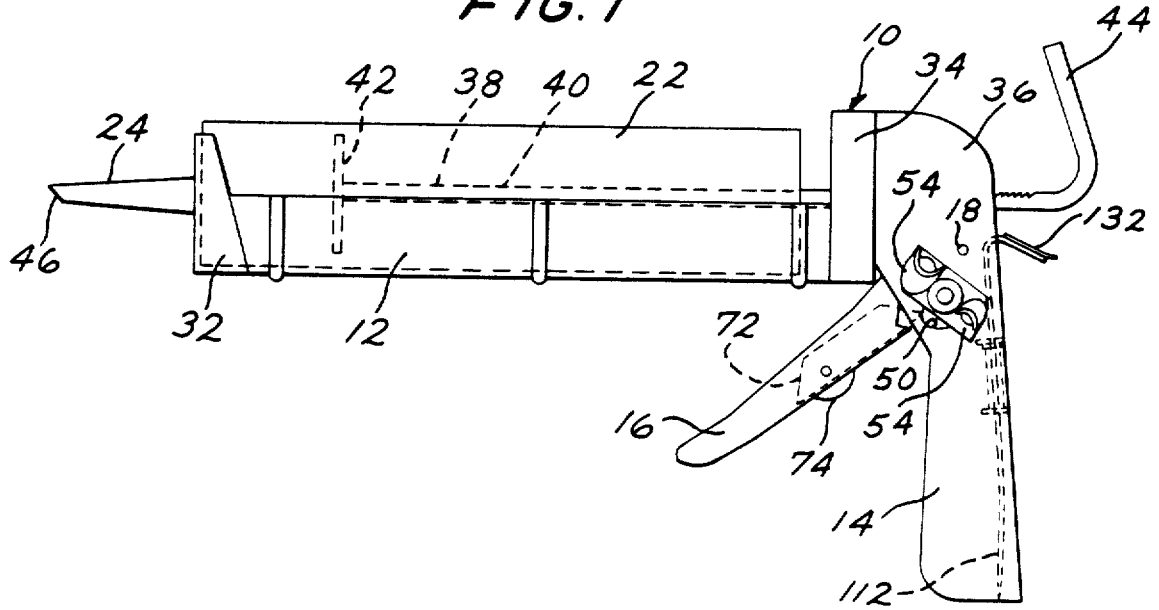
FIG. 1 is side elevational view of a caulking gun that includes a caulking tube-receiving barrel having such a tube positioned therein, where the present invention of a cutting means for the tip of the caulking tube nozzle and a pick for piercing the seal of the tube are built into the hollow handle and the hollow trigger of the gun.

Turning now to a consideration of the drawings, and in particular to the side elevational view of FIG. 1, there is shown a generally standard caulking gun 10 that has been modified to include the inventive concepts of the present invention. The standard features of this gun will be described first in order to illustrate the background or context in which the present invention functions. This gun 10 has three main elements; namely, an elongated semi-cylindrical gun barrel 12, a generally hollow handle 14 at one end of the barrel and a generally hollow trigger 16 pivotally mounted from the handle by means of a pivot pin 18 extending through the handle.

Figure 4:
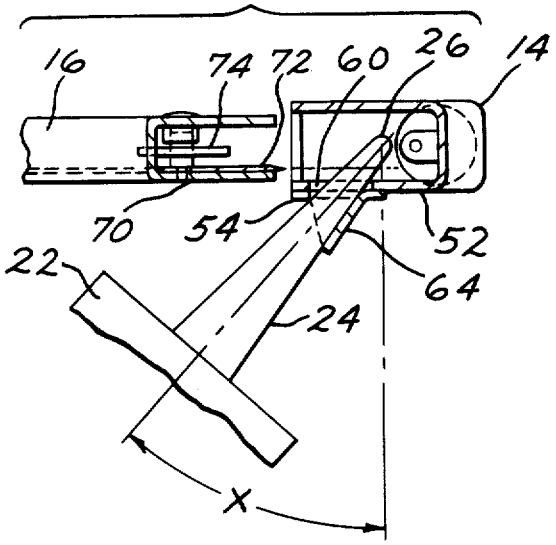
FIG. 4 is a fragmentary cross-sectional plan view through both the handle and the trigger, taken on the line 4—4 of FIG. 2, showing how the nozzle of the caulking tube is inserted at an angle into a hole of one side wall of the handle for use in slicing off the tip of the nozzle.
Figure 6:
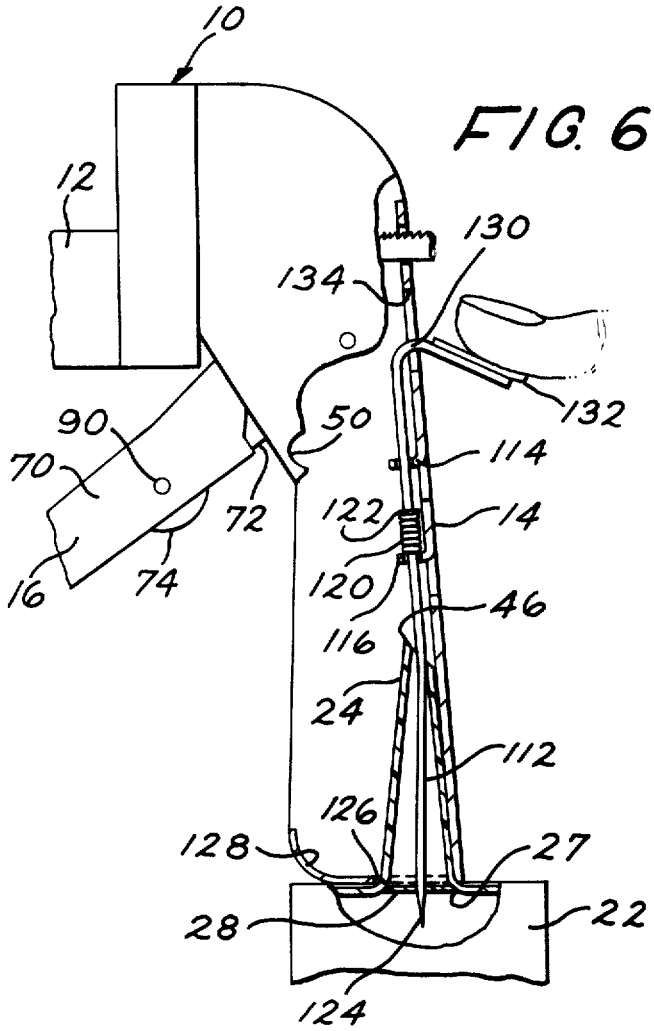
FIG. 6 is a fragmentary side view of the handle end of the gun, similar to that of FIG. 2, with parts of the handle broken away to show on the interior of the handle the use of an extendible pick that is spring mounted within the hollow handle, so that the open nozzle of the caulking tube may be inserted up through the bottom of the handle and onto this extendible pick, so that when the pick is moved downwardly by the thumb, the pick will pierce the seal of the tube.

The semi-cylindrical gun barrel 12 is open at the top to receive the caulking tube or cartridge 22 therein. As is standard, such caulking tubes 22 are fitted with a tapered plastic nozzle or spout 24 which is closed at the tip at the factory in order to maintain the freshness of the caulking within the tube and increase its shelf life. This closed tip 26 of the nozzle 24 is illustrated in FIG. 4. Standard caulking tubes are fitted with a second air-sealing means by sealing the inlet end 27 of the tapered nozzle 24 which is provided with a thin diaphragm 28 of metal or aluminum foil, as is illustrated in FIG. 6. The caulking tube 22, which holds the charge of caulking material, is usually formed of a paper tube construction.

The semi-cylindrical gun barrel 12 has an outlet end cup 32 that is integral with the outlet end of the barrel. This outlet end cup 32 is provided with the usual U-shaped nozzle-access slot (not shown) that is open at the top for receiving the nozzle 24 down therein. An inlet end cup 34 is secured to the opposite end of the gun barrel 12, and it serves the purpose of reinforcing the gun barrel 12 as well as accommodating the upper end 36 of the gun handle 14, which is made integral with the end cup 34 by welding or the like. As is standard in this art, the caulking gun 10 is provided with a plunger 38 comprising an elongated plunger rod 40 having a piston head 42 at one end for acting against the end wall of the caulking tube 22, and a handle 44 at the opposite end of the plunger rod 40. It will be understood by those skilled in the art that the underside of the plunger rod 40 is provided with ratchet teeth (not shown) for cooperation with a ratchet pawl (not shown) that is part of the uppermost end of the pivoted trigger 16, so that each squeezing of the trigger will cause the advance of the plunger rod and hence the advance of the piston head 42 into the interior of the caulking tube 22, thereby applying a compression force on the contents of the caulking tube and causing the contents to extrude out of the open tip 46 of the plastic nozzle 24. In order to withdraw the plunger rod 40 from the caulking tube 22, it is merely necessary to turn the handle 44 so as to disengage the ratchet teeth from the ratchet pawl, and thereby manually pull the plunger rod 40 out of the caulking tube.

Figure 3:
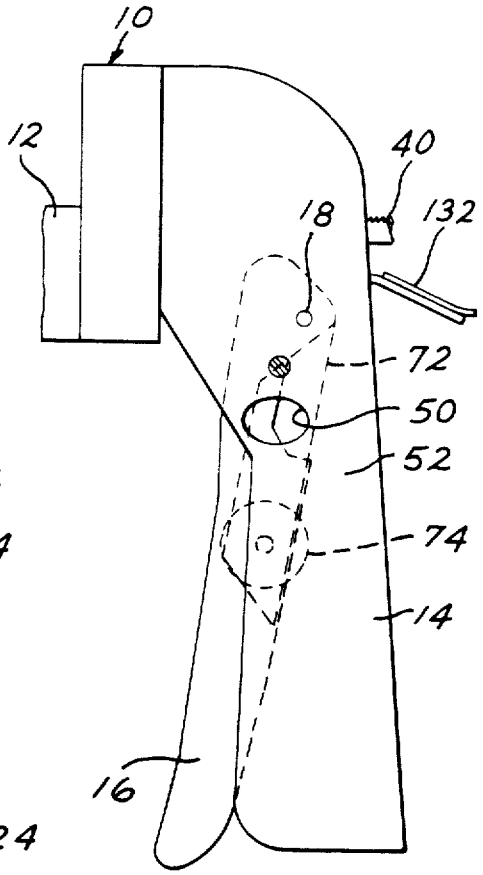
FIG. 3 is a fragmentary view, similar to that of FIG. 2, after the hollow trigger of the gun has been squeezed to show that the trigger nearly passes completely into the hollow handle of the gun.

What has been described above with reference to the patent drawings is the nature of a standard caulking gun of the type that is widely used today. Now to be discussed is the incorporation within the hollow handle 14 and the hollow trigger 16 of a means for cutting off the closed tip 26 of the tapered plastic nozzle 24 in order to provide the open tip 46 of FIG. 1. As is best seen in FIG. 3, an elliptical hole 50 is formed in one side wall 52 of the hollow handle 14. The location of this hole 50 is near the underside of the pivot pin 18. An adjustable adapter 54 is pivotally mounted to the outside of the side wall 52 by means of a pivot pin 56 that is located intermediate the pivot pin 18 and the hole 50, as is clear from FIG. 3. This adjustable adapter 54 is mounted at its center to its pivot pin 56. On each side of the pivot pin the adapter is furnished with a hole 58 and 60. The hole 58 is slightly larger than the hole 60. Each hole is furnished with a curved shroud 62 and 64 respectively, thereby converting each hole into an angular opening for receiving the tapered nozzle 24 at an angle of about 45 degrees from a perpendicular line drawn from the side wall 52, as is clear from the diagrammatic showing of FIG. 4.

Figure 5:
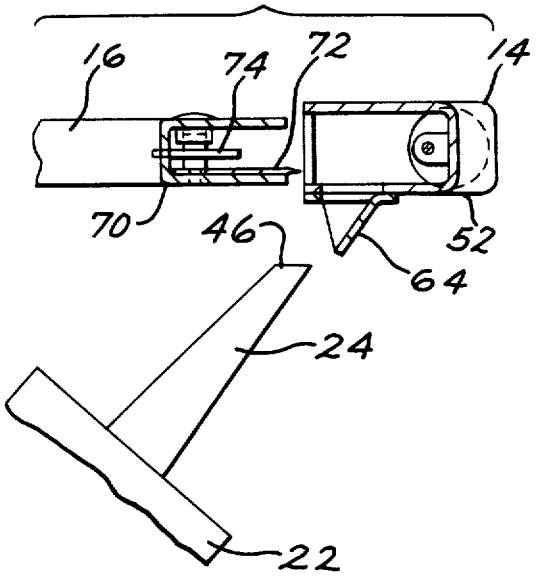
FIG. 5 is a cross-sectional plan view, similar to that of FIG. 4, showing the nozzle of the caulking tube removed from the handle and with the tip of the nozzle being trimmed off at a 45 degree angle.
Figure 7:
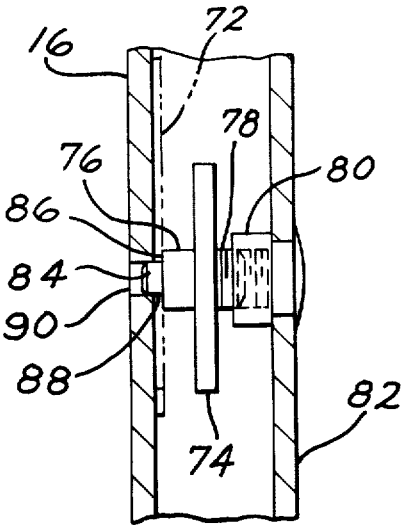
FIG. 7 is a fragmentary cross-sectional view through the hollow trigger, taken on the line 7—7 of FIG. 2, to show the nature of the thumbscrew for adjustably mounting the special razor blade or other keen-edged blade for use as the cutting means for removing the closed tip of the nozzle of a caulking tube.

Now, turning to a consideration of the hollow trigger 16, a notch 68 is formed in the edge of the side wall 70 that is nearest the side wall 52 of the hollow handle 14. This notched edge 68 is located in the vicinity of the elliptical hole 50, and very little of this notched edge is visible in FIGS. 1 and 2 because a razor blade 72 or other type of keen-edged blade is to be positioned in this notched edge to serve as a cutting edge of the closed tip 26 of the nozzle 24 when the trigger 16 is squeezed and the trigger telescopes into the open end of the hollow handle 14, as is best seen in FIG. 3. When this squeezing action takes place, the razor blade 72 passes across the elliptical hole 50 and slices off the closed tip 26 of the nozzle 24 to provide a 45 degree angle cut 46, as is best seen in FIG. 5. This FIG. 5 is a showing after the trigger has been squeezed to slice off the tip of the nozzle and the trigger has returned to its normal position and the caulking tube 22 has been moved away from the gun so that the nozzle 24 is free of the gun. The overall outline or configuration of the razor blade 72 is shown in dotted lines in FIGS. 1 and 2. In order to understand the method of holding the razor blade 72 within the hollow handle 16, reference will now be made to FIG. 7 of the drawing. Positioned within the hollow trigger 16 is a thumbscrew 74 which is a wheel-like member having a central shaft 76 which is threaded on one end 78 into an internally-threaded block 80 that is fixed to the inner side of the side wall 82 of the trigger that is opposite the side wall 70. The other end of the shaft 76 is reduced in size to form a pin 84 and a shoulder 86. The razor blade 72 is provided with a hole 88 that is about the size of the pin 84 so that the pin will enter the hole of the blade. Moreover, the wall 70 of the trigger has a hole 90, again for receiving the pin 84. When the pin 84 extends through the hole 88 in the blade and into the hole 90 in the side wall of the trigger, the shoulder 86 will bear against the side of the blade, as is clear from FIG. 7. In order to replace the blade when it becomes dull, the thumbscrew 74 is turned to thread the shaft 76 into the threaded block 80, thereby removing the pin 84 from the razor blade 72 so that the blade may be disengaged from the trigger and replaced with a new one. The only cutting edge of the razor blade 72 that is exposed is that portion of the blade that is within the notched edge 68. This is important to ensure the safety of the user of this caulking gun so that it is not possible to inadvertently cut a person's finger or hand with the blade.

Figure 2:
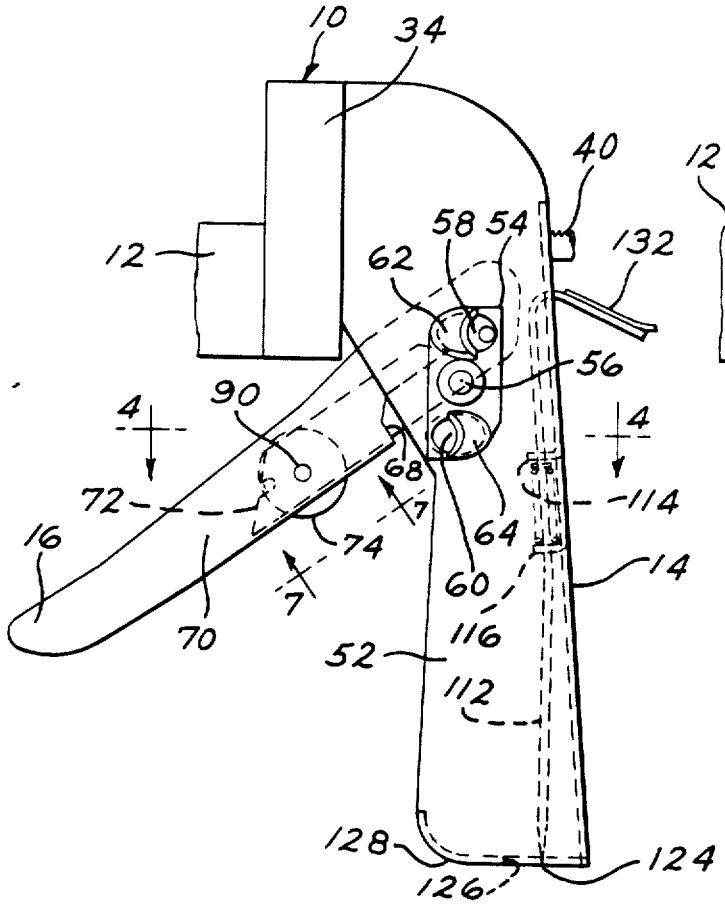
FIG. 2 is a fragmentary view, on an enlarged scale, of one end of the gun of FIG. 1 showing in greater detail the elements of the present invention.

FIGS. 8–10 show a second modification 94 of an adjustable adapter to take the place of the adjustable adapter 54 of FIGS. 1 and 2. Instead of putting the adjustable adapter 54 on the outside of the handle 14, this second modification installs the adjustable adapter 94 within the handle. The elements in FIGS. 8–10, which have not been changed from the elements previously described, will be given the same reference numerals as before. The nature of the razor blade 72 and its thumbscrew 74 has not been altered. The elliptical hole 50 in the handle 14 remains, except that it is fitted with a curved shroud 96 so as to form an angular opening with the hole 50 so that the nozzle 24 of the caulking tube 22 must be inserted at an angle of about 45 degrees into the hole 50, as is best seen in FIG. 10. The wheel-like nature of the adjustable adapter 94 is best seen in FIG. 9. This adapter is formed as a circular disk having a center pivot opening 98 and three nozzle-receiving openings 100, 102 and 104. Each of these openings is of a different size so as to be able to accommodate different sections along the length of the tapered plastic nozzle 24, depending upon what size opening the user wishes in the nozzle. The pivot pin 106 for this adjustable adapter 94 is shown in FIG. 8. In order to assist the user in selecting the proper size of nozzle-receiving opening, indicia is imprinted on the wheel 94 giving the size of the holes that are aligned with the elliptical hole 50. Notice in FIG. 8, there is a window 108 in which the indicia appears each time one of the nozzle-receiving openings is aligned within the hole 50. For instance, in FIG. 8 the indicia ¼ appears in the window. Notice there is also a pointer 110 directed toward the window 108 to draw attention to the indicia within the window.

Reference will now be had to FIGS. 2 and 6 of the drawings for a description of the incorporation of an elongated extendible pick 112 within the hollow handle 14 to serve as a built-in means for piercing the diaphragm 28 that serves as a secondary air seal in the inlet end 27 of the nozzle 24, as is clear from the showing in FIG. 6. A pair of lanced tabs 114 and 116 are struck out of the back edge of the hollow handle 14 and are arranged generally parallel to each other and perpendicular to the back wall. Each tab is furnished with a small hole 18 for receiving the elongated pick 112 therethrough. A helical spring 120 surrounds the pick 112 and is seated on the lower tab 116, and the top end of the spring bears against a stop 122 that is formed integral with the pick. In a normal at-rest position, as shown in FIG. 2, the spring 120 will force the stop 122 against the underside of the top tab 114. In this position, the lower pointed end 124 of the pick is shown withdrawn into the handle 14 and aligned with an opening 126 in a bottom wall 128 of the handle. This opening 126 is of a size to accommodate the largest diameter of the inlet end of the tapered plastic nozzle 24, as is clear from FIG. 6. There is an important reason for this bottom wall 128 and this hole 126, and that is to ensure that the nozzle 24 cannot be shifted off to the side and carry the pick 112 with it, thereby damaging the pick and bending it out of shape. Most standard caulking guns have an open bottom wall as part of the hollow handle 14. This closed bottom wall 128 is an important part of the present invention to ensure long life of the extendible pick 112. The upper end 130 of the extendible pick 112 is formed with an operating lever 132 which extends out of the hollow handle 14 through a vertical slot 134. This operating handle is a thumb rest which can be operated by the same hand that is holding the handle 14 of the gun. The thumb will depress the operating lever 132, causing the pick 112 to extend out through the opening 126 in the bottom wall 128 of the handle and pierce the diaphragm 28 of the caulking tube 22, as is illustrated in FIG. 6. After the nozzle 24 of the caulking tube is removed from the handle, and the thumb is removed from the operating lever 132, the extendible pick 112 will return to its hidden position shown in dotted lines in FIG. 2 where the pointed tip 124 will be withdrawn into the handle and not cause a safety hazard.

Having described above the novel invention of a caulking gun having built into the trigger and handle a means for cutting off the closed tip of the plastic nozzle of a caulking tube, and of providing an extendible pick for piercing the air-sealed diaphragm of the tube located near the inlet end of the nozzle, it will readily be apparent to those skilled in this art that I have contributed to the convenience of the user in opening or unsealing the caulking tubes before they are loaded into the caulking gun. By the use of the present invention, it is possible to cut the tip of the plastic nozzle at a 45-degree angle in an accurate manner which is of much more value to the user because of the way the caulking gun is used, usually at the end of an outstretched arm of the user which is at a small angle with respect to the surface being caulked. If the caulking gun were always used directly in front of the user, then this angular tip would not be so important. However, the gun is mostly used when the user's arms are outstretched and the angular relationship is of vital importance.

Modifications of this invention will occur to those skilled in this art. Therefore, it is to be understood that this invention is not limited to the particular embodiments disclosed, but that it is intended to cover all modifications which are within the true spirit and scope of this invention as claimed.

What is claimed is:

1. In a caulking gun including a caulking tube-receiving barrel having a reciprocating plunger, and a pistol grip-type handle secured to one end of the barrel, a pivot means carried near the top portion of the handle, and a trigger member pivotally mounted on the pivot and adapted for operating the said plunger; the invention comprising:

a. the said handle being of hollow construction, as well as the said trigger member being of hollow construction and tending to telescope into the hollow handle when the trigger is squeezed;

b. a hole formed in one side wall of the handle near the said pivot means;

c. one side wall of the trigger that is nearest the said side wall of the handle with the hole in it having an open notched edge that is adjacent the said hole;

d. and a replaceable keen-edge blade positioned within the said trigger and within the said open notched edge, and an adjustable fastening means within the trigger for clamping the blade in place in the open notched edge of the trigger wall;

e. whereby the said hole in the handle in cooperation with the blade in the open notched edge of one wall of the trigger serve as a cutting means for the tip of the nozzle of a caulking tube when the trigger is squeezed, said open notched edge of the trigger wall being generally positioned within the hollow handle so the blade is shielded from exposure to the user's hand.

2. The invention as recited in claim 1 wherein the said adjustable fastening means for the blade is a thumb screw that is mounted from the side wall of the trigger that is opposite the wall that includes the said open notched edge.

3. The invention as recited in either claims 1, or 2 wherein an adjustable adapter is mounted to the outside of the side wall of the handle that has the said hole formed therein, said adapter having at least two angular openings of different sizes that are each capable of being aligned over the said hole, where each angular opening is capable of receiving the tip of the nozzle of a caulking tube for slicing off the tip of the nozzle at a non-transverse angle, while the larger angular opening allows a larger section of the tip of the nozzle to be removed.

4. The invention as recited in either claims 1, or 2 wherein the said hollow handle is fitted with an elongated extendible pick that has a free end adjacent the lower end of the handle, whereby the pick may be inserted into the open tip of the nozzle of a caulking tube, and the pick may be extended out beyond the bottom of the handle so as to pierce the seal of the tube that is adjacent the base of the nozzle.

5. The invention as recited in claim 1 wherein the said hollow handle is fitted with an elongated extendible pick that has a free end adjacent the lower end of the handle, whereby the pick may be inserted into the open tip of the nozzle of a caulking tube, and the pick may be extended out beyond the bottom of the handle so as to pierce the seal of the tube that is adjacent the base of the nozzle.

6. The invention as recited in claim 5 wherein the said extendible pick is movably supported by a guide member that is located within the said hollow handle, the pick also being supplied with spring means acting against the said guide member for holding the pick within the said handle, the end of the pick that is opposite the said free end being furnished with an operating lever that extends outwardly through an elongated slot in the handle for manual extension of the free end of the pick from the bottom of the handle.

7. The invention as recited in claim 1 wherein an adjustable adapter is pivotally mounted to the said side wall of the handle that includes the said nozzle-receiving hole, said adapter including a plurality of different size nozzle-receiving holes which may each be aligned with the said hole in the handle for governing the particular length of the tip of the nozzle of the caulking tube that may be severed when the trigger is squeezed.

8. The invention as recited in claim 7 wherein an elongated extendible pick retractably mounted within the said hollow handle, the pick having a free end positioned adjacent a bottom wall of the handle, a nozzle-receiving opening formed in the bottom wall of the handle, and lever means for extending the pick out of the bottom of the handle for clearing the nozzle of obstructions and rendering the caulking capable of flow through the nozzle.

9. The invention as recited in claim 8 wherein the said adjustable adapter is pivotally mounted on the outside of the said housing wall, each of said nozzle-receiving holes having a curved shroud partially covering the hole to render each such hole an angular opening for making an angular cut of the tip of the nozzle.

10. The invention as recited in claim 8 wherein the said adjustable adapter is pivotally mounted on the inside of the said housing wall, and a curved shroud partially covering the said nozzle-receiving hole in the side wall of the handle to render that hole an angular opening for making an angular cut of the tip of the nozzle.

11. The invention as recited in claim 10 wherein the said adjustable adapter is provided with indicia denoting the relative size of each nozzle-receiving hole therein, the said side wall of the handle including a window for viewing the specific indicia one at a time relative to its respective hole.

12. In a caulking gun including a caulking tube-receiving barrel having a reciprocating plunger, and a pistol grip-type handle secured to one end of the barrel, a pivot means carried near the top portion of the handle, and a trigger member pivotally mounted on the pivot and adapted for operating the said plunger; the invention comprising:

a. the said handle being of hollow construction, and the said trigger being of [illegible] construction, where the trigger tends to telescope into the hollow handle when the trigger is squeezed;

b. a hole formed in one side wall of the handle near the said pivot means;

c. one side wall of the trigger that is the nearest to the said side wall of the handle with the hole in it having a notched edge that is adjacent the said hole;

d. and a razor blade fixed within the said trigger adjacent the said notched edge whereby the combination of the hole in the handle and the razor blade in the trigger serves as a cutting means for the tip of the nozzle of a caulking tube when the trigger is squeezed;

e. and a retractable pick positioned within the handle and having a free end adjacent the lower end of the handle, whereby the pick may be inserted into the open tip of the nozzle of a caulking tube, and the pick may be extended from its retracted position so as to pierce the seal of the tube that is adjacent the base of the nozzle.

13. The invention as recited in claim 12 wherein the said retractable pick is movably supported by a guide member that is located within the said hollow handle, the pick also being supplied with spring means acting against the said guide member for retracting the pick within the said handle, the end of the pick that is opposite the free end of the pick being furnished with a operating lever that extends outwardly through an elongated slot in the handle for manual extension of the free end of the pick from the bottom of the handle so as to pierce the seal of the tube.

14. The invention as recited in claims either 5, 6, 10 or 13 wherein the lower end of the said hollow handle is provided with a bottom wall having a nozzle-receiving guide hole therein that is generally aligned with the free end of said pick to protect the pick from being bent out of shape.

15. In a caulking gun including a caulking tube-receiving barrel having a reciprocating plunger, and a pistol grip-type handle secured to one end of the barrel, a pivot means carried near the top portion of the handle, and a trigger member pivotally mounted on the pivot and adapted for operating the said plunger; the invention comprising:

a. the said handle being of hollow construction, as well as the said trigger member being of hollow construction and tending to telescope into the hollow handle when the trigger is squeezed;

b. a hole formed in one side wall of the handle near the said pivot means;

c. and a keen-edged blade positioned within the said trigger and extendable into the said handle when the trigger is depressed, said hole in the handle in cooperation with the blade in the trigger serving in conjunction as a cutting means for the tip of a nozzle of a caulking tube when the trigger is squeezed;

d. an adjustable adapter mounted to the outside of the sidewall of the handle that has the said hole formed therein, said adapter having at least two angular openings of different sizes that are each capable of being aligned over the said hole in the handle, where each angular opening is capable of receiving the tip of the nozzle of a caulking tube for slicing off the tip of the nozzle at a non-transverse angle, while the larger angular opening allows a larger section of the tip of the nozzle to be removed.

16. In a caulking gun including a caulking tube-receiving barrel having a reciprocating plunger, and a pistol grip-type handle secured to one end of the barrel, a pivot means carried near the top portion of the handle, and a trigger member pivotally mounted on the pivot and adapted for operating the said plunger; the invention comprising:

a. the said handle being of hollow construction, as well as the said trigger member being of hollow construction and tending to telescope into the hollow handle when the trigger is squeezed;

b. a hole formed in one side wall of the handle near the said pivot means;

c. and a keen-edged blade positioned within the said trigger and extendable into the said handle when the trigger is depressed, said hole in the handle in cooperation with the blade in the trigger serving in conjunction as a cutting means for the tip of a nozzle of a caulking tube when the trigger is squeezed;

d. the said hollow handle being fitted with an elongated extendable pick that has a free end positioned adjacent the lower end of the handle, whereby the pick may be inserted into the open tip of the nozzle of a caulking tube, and the tip may be extended out beyond the bottom of the handle so as to pierce the seal of the tube that is located adjacent the base of the nozzle.

17. In a caulking gun including a caulking tube-receiving barrel having a reciprocating plunger, and a pistol grip-type handle secured to one end of the barrel, a pivot means carried near the top portion of the handle, and a trigger member pivotally mounted on the pivot and adapted for operating the said plunger; the invention comprising:

a. the said handle being of hollow construction, as well as the said trigger member being of hollow construction and tending to telescope into the hollow handle when the trigger is squeezed;

b. a hole formed in one side wall of the handle near the said pivot means;

c. and a keen-edged blade positioned within the said trigger and extendable into the said handle when the trigger is depressed, said hole in the handle in cooperation with the blade in the trigger serving in conjunction as a cutting means for the tip of a nozzle of a caulking tube when the trigger is squeezed;

d. and an adjustable adapter pivotally mounted on the inside of the wall of the handle having the said hole therein, said adapter including a pluraltiy of different size nozzle-receiving holes which may each be aligned with the said hole in the handle for governing the particular length of the tip of the nozzle of the caulking tube that may be severed when the trigger is squeezed, and a curved shroud partially covers the hole in the handle so that the nozzle of the tube can only enter the hole in the handle at an angle that is not perpendicular to the wall of the handle that has the hole therein.

* * * * *